US005460432A

United States Patent [19]

Yamazaki et al.

[11] Patent Number: 5,460,432

[45] Date of Patent: Oct. 24, 1995

[54] CUTTER HEAD FOR A TUNNEL EXCAVATOR

[75] Inventors: Toshihiro Yamazaki; Yasushige Yomiyama, both of Hirakata, Japan

[73] Assignee: Kabushiki Kaisha Komotsu Seisakusho, Tokyo, Japan

[21] Appl. No.: 200,229

[22] Filed: Feb. 23, 1994

[30] Foreign Application Priority Data

Mar. 29, 1993 [JP] Japan ..... 5-020042 U

[51] Int. Cl.[6] ..... E21B 10/00

[52] U.S. Cl. ..... 299/106; 299/55; 299/104; 405/141

[58] Field of Search ..... 405/138, 141; 299/55, 79, 88–91

[56] References Cited

U.S. PATENT DOCUMENTS

| | | | |
|---|---|---|---|
| 4,171,848 | 10/1979 | Ono | 405/141 X |
| 4,804,295 | 2/1989 | Kondo | 405/138 X |
| 5,308,150 | 5/1994 | Whitehouse | 299/90 X |

FOREIGN PATENT DOCUMENTS

| | | | |
|---|---|---|---|
| 3130900 | 2/1983 | Germany | 405/138 |
| 1-38959 | 8/1989 | Japan . | |
| 91395 | 3/1990 | Japan | 405/141 |
| 209595 | 8/1990 | Japan | 405/141 |
| 115699 | 5/1991 | Japan | 405/141 |

*Primary Examiner*—John A. Ricci
*Attorney, Agent, or Firm*—Flynn, Thiel, Boutell & Tanis

[57] ABSTRACT

In a tunnel excavator for tunneling by rotating a cutter head provided in front of a shield body to thereby excavate the working face of a tunnel using disk cutters attached to the front surface of the cutter head, the cutter head is composed of an annular beam, an arched main spoke provided across the annular beam and a plurality of arched sub-spokes radially provided thereon and disk cutter assemblies are detachably attached to the main spoke and sub-spokes, so that the disk cutter has a simple structure and the reaction force of excavation is broken up by the main spoke and sub-spokes to be transmitted to the annular beam. As a result, it is possible to provide a strong and durable cutter head which can be easily manufactured.

2 Claims, 5 Drawing Sheets

CUTTER HEAD FOR A TUNNEL EXCAVATOR

BACKGROUND OF THE INVENTION

1. Field of the Invention

The present invention relates to a cutter head for a tunnel excavator which is improved in frame construction.

2. Prior Art

A prior art tunnel excavator for tunneling comprises a cutter head rotatably provided in front of a shield body for excavating the working face of a tunnel.

Particularly a tunnel excavator for excavating a rock bed comprises a cutter head equipped with a plurality of disk cutters rotatably attached to the front surface thereof for excavating the rock bed, but they are worn away after excavating a long distance to lower the efficiency of excavation.

Accordingly, various ideas are proposed to facilitate the exchange of the worn-out disk cutters from inside the cutter head.

For example, there is proposed in the Japanese Patent Publication No. 1 - 38959 a cutter head comprising a central hub provided in the central portion thereof and a plurality of spokes which radially project from the central hub, wherein disk cutters can be attached to or detached from the central hub and the spokes from inside the cutter head.

The prior art cutter head described above, however, has such drawbacks in that it requires numerous steps for accurately positioning the central hub in the central portion of the cutter head in manufacturing the same which employs a frame construction of supporting the central hub provided in the central portion thereof by a plurality of radially projecting spokes so that it is not so easily assembled and moreover if the central hub is not accurately positioned therein, an abnormal load is applied to the disk cutters attached to the central hub so that the life thereof is shortened.

The present invention has been made in view of the conventional drawbacks to provide a cutter head for a tunnel excavator having a strong and easily manufacturable frame construction.

SUMMARY OF THE INVENTION

In order to attain the above object, the present invention provides a cutter head for a tunnel excavator which tunnels using disk cutters attached to the front surface of the cutter head provided in the front portion of a shield body by rotating the cutter head, wherein the cutter head is composed of an annular beam, an arched main spoke provided across the annular beam and a plurality of arched sub-spokes radially provided thereon and disk cutter assemblies are detachable attached to the main spoke and the sub-spokes.

With such construction set forth above, the cutter head can have a simple frame construction being composed of the main spoke, the sub-spokes and the annular beam to facilitate its manufacturing and assembling and the reaction force of excavation is broken up to the main spoke and the sub-spokes to be transmitted to the annular beam so as to be received thereby, so that the strength and durability of the cutter head are further improved.

BRIEF DESCRIPTION OF THE DRAWINGS

FIG. 4 (*b*) is a side view of the disk cutter mounting plate provided on the main spoke of the cutter head in FIG. 1.

DESCRIPTION OF THE PREFERRED EMBODIMENT

Figure 1:
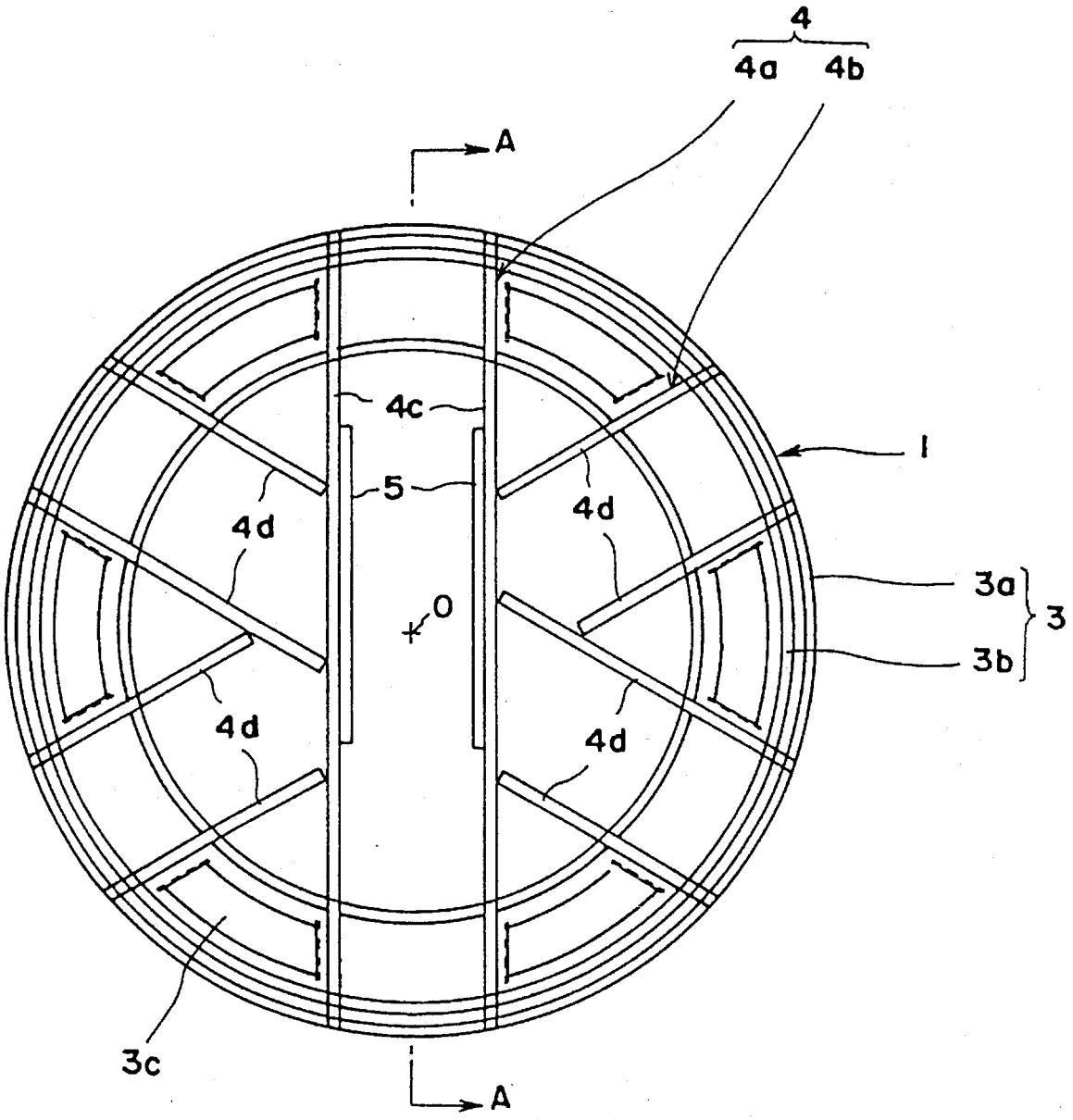
FIG. 1 is a front view of a tunnel excavator equipped with a cutter head according to an embodiment of the present invention.
Figure 2:
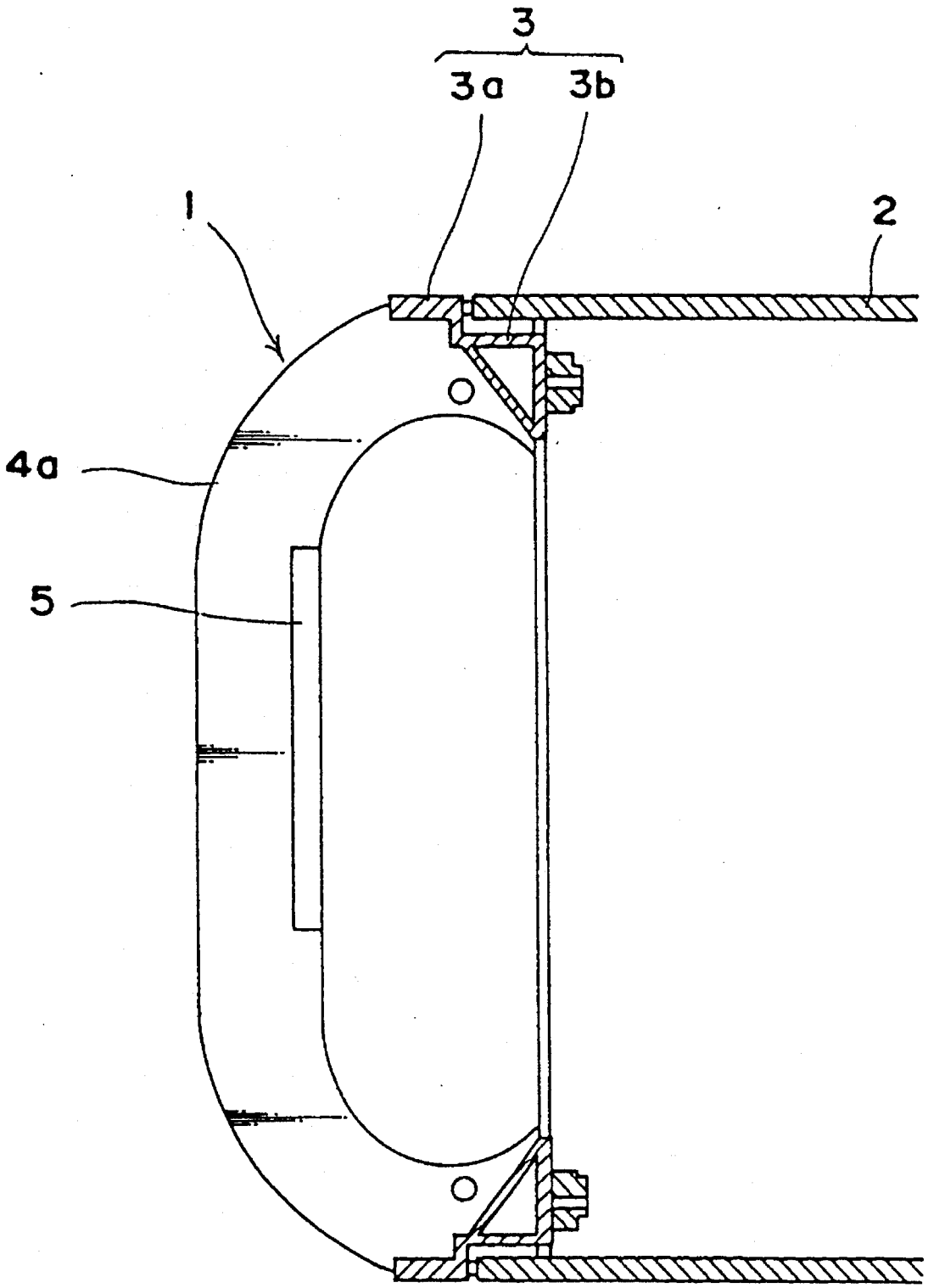
FIG. 2 is a cross-sectional view of the cutter head taken along a line A—A in FIG. 1.
Figure 3:
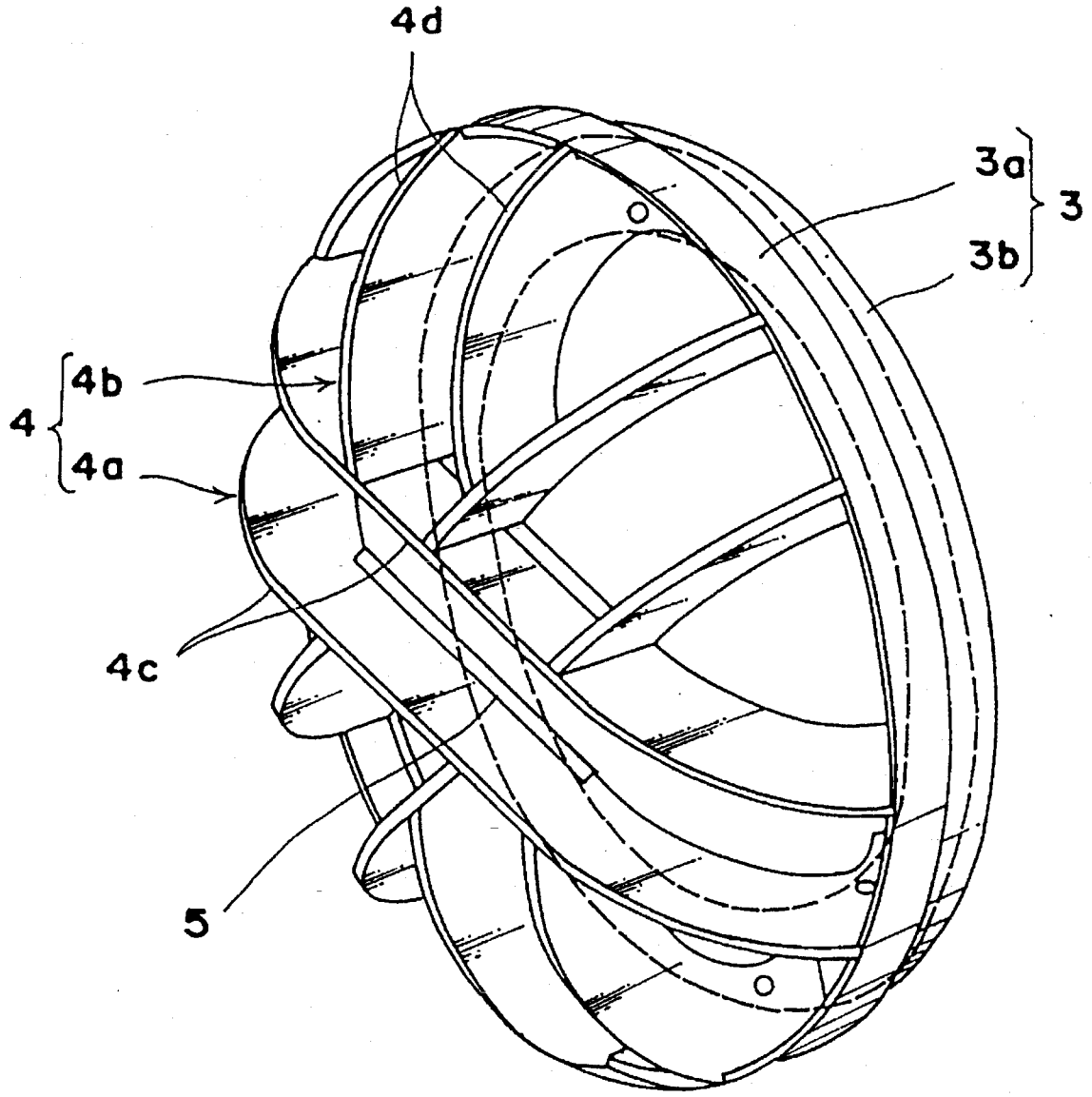
FIG. 3 is a perspective view of the cutter head in FIG. 1.

An embodiment of the invention will be described in detail with reference to drawings.

In the figures, denoted at 1 is a cutter head rotatably attached to the front portion of a shield body 2.

The cutter head 1 set forth above has a frame construction composed of an annular beam 3 and spokes 4 provided radially in front of the annular beam 3.

The annular beam 3 is composed of an annular portion 3*a* having an outer diameter substantially as large as that of the shield body 2 and an annular portion 3*b* having a diameter slightly less than the internal diameter of the shield body 2, and the spokes 4 are fixed to these annular portions 3*a* and 3*b* at the both ends thereof.

The above spokes 4 are a main spoke 4*a* provided across the annular beam 3 and a plurality of sub-spokes 4*b* radially provided thereon.

The above main spoke 4*a* is composed of two arched side plates 4*c* which are arranged apart from each other from the center O of the cutter head 1 therebetween and are connected to the annular beam 3 at the both ends thereof.

Each of a pair of disk cutter mounting plates 5 is fixed to each of the side plates 4*c* adjacent to the central portion thereof at positions a little deviated from the center O of the cutter head 1.

Figure 4A:
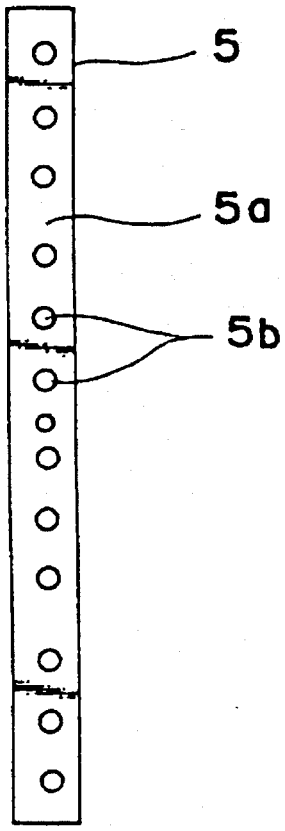
FIG. 4 (*a*) is a front view of a disk cutter mounting plate provided on the main spoke of the cutter head in FIG. 1.
Figure 4B:
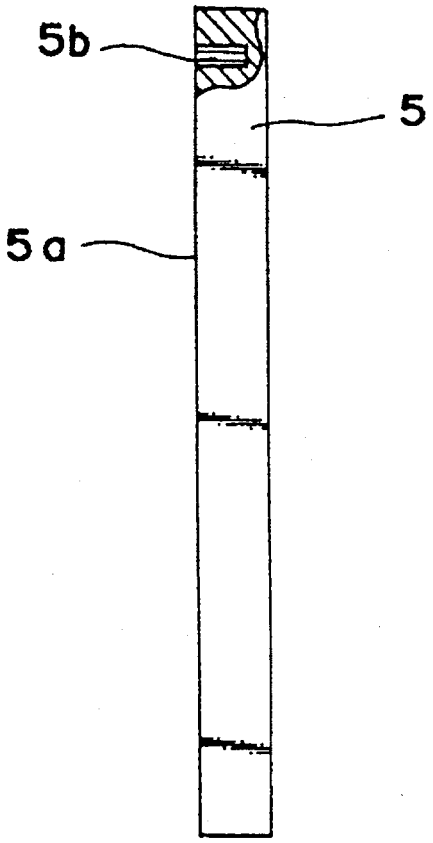

These disk cutter mounting plates 5 each having a shape of a square pillar comprises a plurality of mounting holes 5*b* perforated at intervals on the mounting surface 5*a* thereof and disk cutter assemblies 6, described later, are attached to these mounting holes 5*b* as illustrated in FIG. 4.

The sub-spokes 4*b* are also composed of two arched side plates 4*d* which are arranged apart from each other in the same way as the main spoke 4*a* and the sub-spokes 4*b* are arranged in x-shape such that the center line of a first pair of the side plates 4*d* intersects that of a second pair of the side plates 4*d* at the center O of the cutter head 1. The first pair of sub-spokes 4*b* are connected to the main spoke 4*a* at the inner ends thereof while the second pair of sub-spokes 4*b* are connected to the main spoke 4*a* at the inner ends of one of the side plates 4*d* thereof and to the first pair of sub-spokes 4*b* at the inner ends of the other side plates 4*d* thereof. All the sub-spokes 4*b* are connected to the annular beam 3 at the outer ends thereof as illustrated in FIG. 1.

Disk cutter assemblies 6 are mounted between the side plates 4*d* of the sub-spokes 4*b* at the positions which are radially different from one another.

Figure 5:
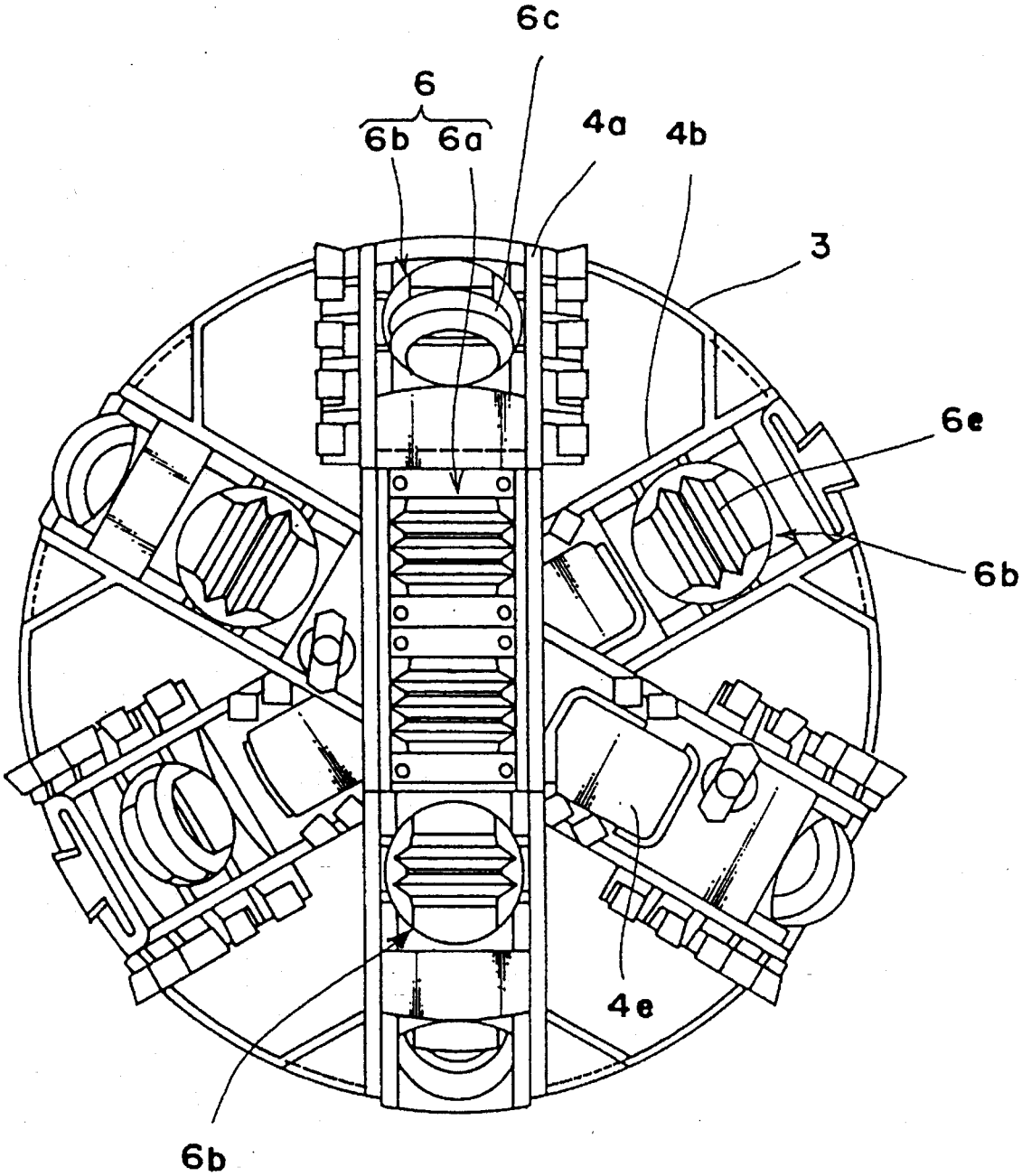
FIG. 5 is a front view of the cutter head in FIG. 1 wherein disk cutter assemblies are attached thereto.

The disk cutter assemblies 6 set forth above are classified into two types, i.e., central disk cutter assemblies 6*a* and circumferential disk cutter assemblies 6*b*, each of the central disk cutter assemblies 6*a* and circumferential disk cutter assemblies 6*b* comprising a rotatable disk cutter 6*c* therein. The central disk cutter assemblies 6*a* are detachably attached to the disk cutter mounting plates 5 adjacent to the center of the main spoke 4*a* while the circumferential disk cutter assemblies 6*b* are detachably attached to the main spoke 4*a* and the sub-spokes 4*b* as illustrated in FIG. 5.

In the figure, denoted at 4*e* are intakes for soil and sand provided in the sub-spokes 4*b* at a part thereof.

The operation of the cutter head 1 having the construction set forth above will be described hereinafter.

In tunneling, the shield body 2 is advanced into the earth while rotating the cutter head 1 to thereby excavate the working face using the disk cutters 6*c* rotatably provided in front of the cutter head 1, and the reaction force of excavation is transmitted to the annular beam 3 by way of the main spoke 4*a* and sub-spokes 4*b* on which the disk cutter assemblies 6 are mounted so as to be received by the cutter head 1 by way of the annular beam 3.

In case the disk cutter 6*c* are worn out after a long distance excavation, the disk cutter assemblies 6 can be easily exchanged by detaching the worn-out disk cutter assemblies 6 from the main spoke 4*a* and sub-spokes 4*b* and attaching a new disk cutter assemblies 6 thereto from inside the cutter head 1.

As described above in detail, according to the present invention, since each cutter head is composed of an annular beam, an arched main spoke provided across the annular beam and a plurality of arched sub-spokes radially provided thereon and disk cutters are mounted on the main spoke and sub-spokes set forth above, there is no need to provide a central hub as in the conventional cutter heads.

As a result, the operation of centering the central hub etc. is not necessary so that the cutter head can be manufactured with ease, and the reaction force of excavation is distributed between the main spoke and the sub-spokes so as to be transmitted to the annular beam so as to be received thereby, so that the strength and durability of the cutter head can be remarkably improved.

What is claimed is:

1. A cutter head for a tunnel excavator which tunnels using disk cutters attached to the front surface of a cutter head provided in the front portion of a shield body by rotating said cutter head, wherein said cutter head comprises:

an annular beam, said beam defining a center;

a main spoke comprising a pair of arched side plates, each said side plate having a pair of opposed ends, said side plates being mounted to said annular beam at the opposed ends thereof and said side plates being arranged across said annular beam and spaced apart from each other symmetrically with respect to a center line which passes the center of said annular beam;

a plurality of sub-spokes each comprising a pair of arched side plates fixedly mounted between said annular beam and said main spoke, said side plates forming each sub-spoke being arranged apart from each other symmetrically with respect to a center line which passes the center of said annular beam and intersects the center line of said main spoke in an x-shape; and disk cutter assemblies detachably attached to said main spoke and sub-spokes.

2. A cutter head for a tunnel excavator according to claim 1, wherein: each said sub-spoke side plate includes an outer end and an inner end: and said sub-spokes include two pairs of sub-spokes, a first pair of sub-spokes being arranged on a first center line and fixed to said main spoke at the side plate inner end; thereof, while a second pair of sub-spokes are arranged on a second center line intersecting said first center line at the center of said annular beam, each sub-spoke of said second pair being fixed to said main spoke at the inner end of one of the side plates thereof and to said first pair of sub-spokes at the inner end of the other side plate thereof and said side plates forming the first and second sub-spokes being fixed to said annular beam at the outer ends of said side plates.

* * * * *

UNITED STATES PATENT AND TRADEMARK OFFICE

CERTIFICATE OF CORRECTION

PATENT NO. : 5 460 432

DATED : October 24, 1995

INVENTOR(S) : Toshihiro YAMAZAKI, et al

It is certified that error appears in the above-indentified patent and that said Letters Patent is hereby corrected as shown below:

On the title page, item [75] and in column 1; change "Yasushige Yomiyama" to ---Yasushige Tomiyama---.

Column 4, line 25; change "end:" to ---end;---.

Column 4, line 28; change "end;" to ---ends---.

Signed and Sealed this

Ninth Day of April, 1996

Bruce Lehman

*Attest:*

BRUCE LEHMAN

*Attesting Officer*

*Commissioner of Patents and Trademarks*